US009117431B1

(12) United States Patent
Rudes

(10) Patent No.: US 9,117,431 B1
(45) Date of Patent: Aug. 25, 2015

(54) GUITAR ACCESSORY FOR PERSONAL ELECTRONIC EQUIPMENT

(71) Applicant: Michael D. Rudes, Dix Hills, NY (US)

(72) Inventor: Michael D. Rudes, Dix Hills, NY (US)

( * ) Notice: Subject to any disclaimer, the term of this patent is extended or adjusted under 35 U.S.C. 154(b) by 155 days.

(21) Appl. No.: 13/914,972

(22) Filed: Jun. 11, 2013

Related U.S. Application Data

(60) Provisional application No. 61/657,979, filed on Jun. 11, 2012.

(51) Int. Cl.

| | |
|---|---|
| ***G10H 1/32*** | (2006.01) |
| ***G10H 1/00*** | (2006.01) |
| ***G10H 1/34*** | (2006.01) |
| ***G10H 7/00*** | (2006.01) |

(52) U.S. Cl.
CPC . *G10H 1/32* (2013.01); *G10H 1/00* (2013.01); *G10H 1/342* (2013.01)

(58) Field of Classification Search
CPC ..... G10H 1/32; G10H 1/00; G10H 1/342
USPC ..... 84/644, 645, 615, 737, 743
See application file for complete search history.

(56) References Cited

U.S. PATENT DOCUMENTS

| | | | | |
|---|---|---|---|---|
| 5,739,455 | A * | 4/1998 | Poon | 84/615 |
| 5,837,912 | A * | 11/1998 | Eagen | 84/267 |
| 7,262,359 | B1 * | 8/2007 | Edwards et al. | 84/723 |
| 7,799,986 | B2 * | 9/2010 | Ryle et al. | 84/737 |
| 7,818,078 | B2 * | 10/2010 | Iriarte | 700/94 |
| 7,982,124 | B1 * | 7/2011 | Landis et al. | 84/727 |
| 8,093,486 | B2 * | 1/2012 | Behringer et al. | 84/615 |
| 8,193,768 | B2 * | 6/2012 | Hallett | 320/108 |
| 8,481,832 | B2 * | 7/2013 | Lloyd | 84/329 |
| 8,598,444 | B2 * | 12/2013 | Morrissey et al. | 84/743 |
| 8,710,346 | B2 * | 4/2014 | Behringer et al. | 84/644 |
| 8,772,620 | B2 * | 7/2014 | Robertson | 84/735 |
| 8,796,529 | B2 * | 8/2014 | Butera et al. | 84/722 |
| 2003/0196542 | A1 * | 10/2003 | Harrison, Jr. | 84/737 |
| 2005/0183566 | A1 * | 8/2005 | Nash | 84/601 |
| 2005/0213297 | A1 * | 9/2005 | Ulla et al. | 361/683 |
| 2007/0090241 | A1 * | 4/2007 | Risse | 248/214 |
| 2007/0131100 | A1 * | 6/2007 | Daniel | 84/737 |
| 2007/0234880 | A1 * | 10/2007 | Adams et al. | 84/601 |
| 2007/0240174 | A1 * | 10/2007 | Hynecek et al. | 720/600 |
| 2008/0184864 | A1 * | 8/2008 | Holt et al. | 84/267 |
| 2009/0218985 | A1 * | 9/2009 | Hallett | 320/108 |
| 2009/0233547 | A1 * | 9/2009 | Ong et al. | 455/41.2 |
| 2010/0064883 | A1 * | 3/2010 | Gynes | 84/645 |
| 2010/0217413 | A1 * | 8/2010 | Seiler | 700/94 |
| 2011/0088535 | A1 * | 4/2011 | Zarimis | 84/645 |
| 2012/0194994 | A1 * | 8/2012 | Lloyd | 361/679.41 |
| 2012/0297962 | A1 * | 11/2012 | O'Donnell et al. | 84/645 |
| 2012/0318121 | A1 * | 12/2012 | Mittelstadt et al. | 84/743 |

FOREIGN PATENT DOCUMENTS

| | | | |
|---|---|---|---|
| PT | WO 2014/071474 | A1 * | 5/2014 |
| WO | WO 2014071474 | A1 * | 5/2014 |

* cited by examiner

*Primary Examiner* — David Warren
*Assistant Examiner* — Christina Schreiber
(74) *Attorney, Agent, or Firm* — Robert C. Montgomery; Montgomery Patent & Design, LLC.

(57) ABSTRACT

An electronic device adapter for storing and mounting a computer application device such as a smart phone or a personal computer comprises a guitar body and an adapter which enables a user to play the guitar in a wired or wireless manner while accessing music applications, adjusting sound levels, and downloading music. The computer application device is positioned and secured upon the rear surface of the guitar.

8 Claims, 7 Drawing Sheets

GUITAR ACCESSORY FOR PERSONAL ELECTRONIC EQUIPMENT

RELATED APPLICATIONS

The present invention is a continuation-in-part of U.S. Application No. 61/657,979, filed Jun. 11, 2012, the entire disclosures of which are incorporated herein by reference.

FIELD OF THE INVENTION

The present invention relates generally to accessory units for use with portable electronic devices and, more particularly, to a guitar connectable to a portable electronic device.

BACKGROUND OF THE INVENTION

Computers have revolutionized modern society. They enable us to perform tasks that we never dreamed of possible. One (1) facet of this enablement is affording us to do more with less. This desire is normally necessitated by efficiency, but this is not always the case. Many times we want to do more with less to exploit all aspects of our mental faculty and skill. This is not more apparent than with the pursuit of the arts, and in particular the musical arts. Composing and performing music requires reasoning, aptitude, and talent. It also entails being able to exploit all of these simultaneously, and with improvisation. It is important for a musician, or any artists for that matter, to be able to compose and re-compose to set the mood and react to the mood. Modern guitars incorporate several electronics to assist the guitarists in exploiting the mental faculty and skill that the guitarist has to offer. However, with the advent of personal, portable computers that can be interfaced with various electronics devises, guitarist would benefit from taking advantage of such technological advancement. It would be beneficial to have a guitar that can be played as it normally is, and to have it interfaced with a personal, portable computer that can provide the guitarists with a plethora of operational functions for the guitar. The development of guitar accessory for personal electronic equipment fulfills this need.

Prior art in this field consists of guitars and music systems that incorporate the enhanced functions within the system. These systems are elaborate and expensive. Despite their elaborate nature, they are still limiting. The limiting feature of these systems is that the user is stuck with the specific functions that are incorporated. Changing or modifying the functions requires significant modifications or software updates to the system itself. Furthermore, these systems are large and bulky. In addition to music systems that music performers use, there are brackets and interfacing apparatuses that have been developed over the years to assist with connecting personal, portable computers to other electronic devices. Yet, these are either very general set-ups or very device-specific. General set-ups consist of some type bracket or cradle that retains the computer in close proximity to a device so as to facilitate an easy connection between the two (2). Other more robust apparatuses enable interfacing so as to allow a user to control a device after the computer is connected, but these are limited to speakers, televisions, and other similar entertainment systems. There is no electronic adapter apparatus to enable a user to mount a computer onto a guitar, and manipulate the guitar features, as well as coordinate the other music systems connected to the guitar, through the computer as the user independently plays the guitar with his hands.

It is an object of this invention to have a guitar that can be played in various operational modes, one (1) of them being with the aid of a personal, portable computer connected to it. It is a further object of this invention to provide that guitar with enhanced features that a user can manipulate with the interfacing aspects of the computer. An additional benefit is for the guitar to be compatible with the commonly used personal, portable computers that pervade society such as a smart phone or a tablet. An additional benefit is for the interfacing to be configured such that manipulation can be achieved through the development of application software downloadable and modifiable on the personal, portable computer. A further benefit is to provide an ancillary stand to retain and support a personal, portable computer that is too large and heavy to be connected directly to the guitar during play.

SUMMARY OF THE INVENTION

The present invention relates to a guitar and guitar accessory, which provides an adapter and a docking station for a personal, portable computer. The apparatus can be operated in a normal guitar fashion or the apparatus can be enhanced with the addition of an existing personal, portable computer. A user is able to access music, apps, or similar features integral to the computers to enhance the operation of the apparatus. The apparatus comprises common features of a guitar such as a body, a neck, guitar strings, tuning pegs, etc. A key feature is that the body includes a switch to enables a user to toggle between a normal guitar mode and an enhanced digital mode of the apparatus with an attached computer. A second key feature is a computer insert positioned on a surface of the body.

The switch is electrically interconnected to internal circuitry of the apparatus. A surface of the apparatus has various inputs, which are also electrically interconnected to the internal circuitry, to further enhance the playing of the apparatus. The inputs include a XLR port, a plurality of memory inputs, a female connector for electrical interconnection to electrical components, a HDMI output, a headphone input, and an amp input. It is envisioned for other electrical inputs and controls to be supplied on the body to further enhance the playing of the apparatus. A surface of the body further comprises an insert to enable a computer to be mounted flush against the apparatus. The computer is mounted in such a way as to display a front face of the computer toward the user to enable user access. Once inserted, the computer is electrically interconnected to the circuitry via a connector charging/docking port.

The apparatus can be played in a normal guitar mode without the addition of the computer. In this mode, a user can still connect the apparatus to existing guitar electrical equipment just as any other guitar. When the apparatus employs the computer, the computer can be used to wirelessly accesses apps, games, music, etc. to play the guitar in enhanced modes. The circuitry of the apparatus comprises converters, microprocessors, RF chips, and transceivers to enable the use of Bluetooth technology and WiFi technology. The switching and circuitry enables a user, at his discretion, to have the apparatus communicate wirelessly with the various electrical equipment commonly used while performing, such as guitar amp. The apparatus is further provided with a portable charging stand that supports and retains the apparatus, as well as provides charging capabilities to the computer. The stand is equipped with an extension that transitions into a neck retainer. The neck retainer engages the neck of the apparatus for support. A power plug with integral input jack is also provided to enable connection to a household electrical outlet.

A user uses the device in either normal operational mode or in enhanced mode. After connecting the apparatus to an existing guitar amp, the switch is toggled into normal guitar mode. The apparatus is then played in common guitar mode. After switching the toggle switch to enhanced mode, a user connects a computer to the apparatus via the connector. A user then exploited the use of the XLR port, memory input, female connector, HDMI output, headphone input, and amp input at his discretion. A user can also activate the computer to access desired programs to further enhance the musical presentation and expression while playing the guitar.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
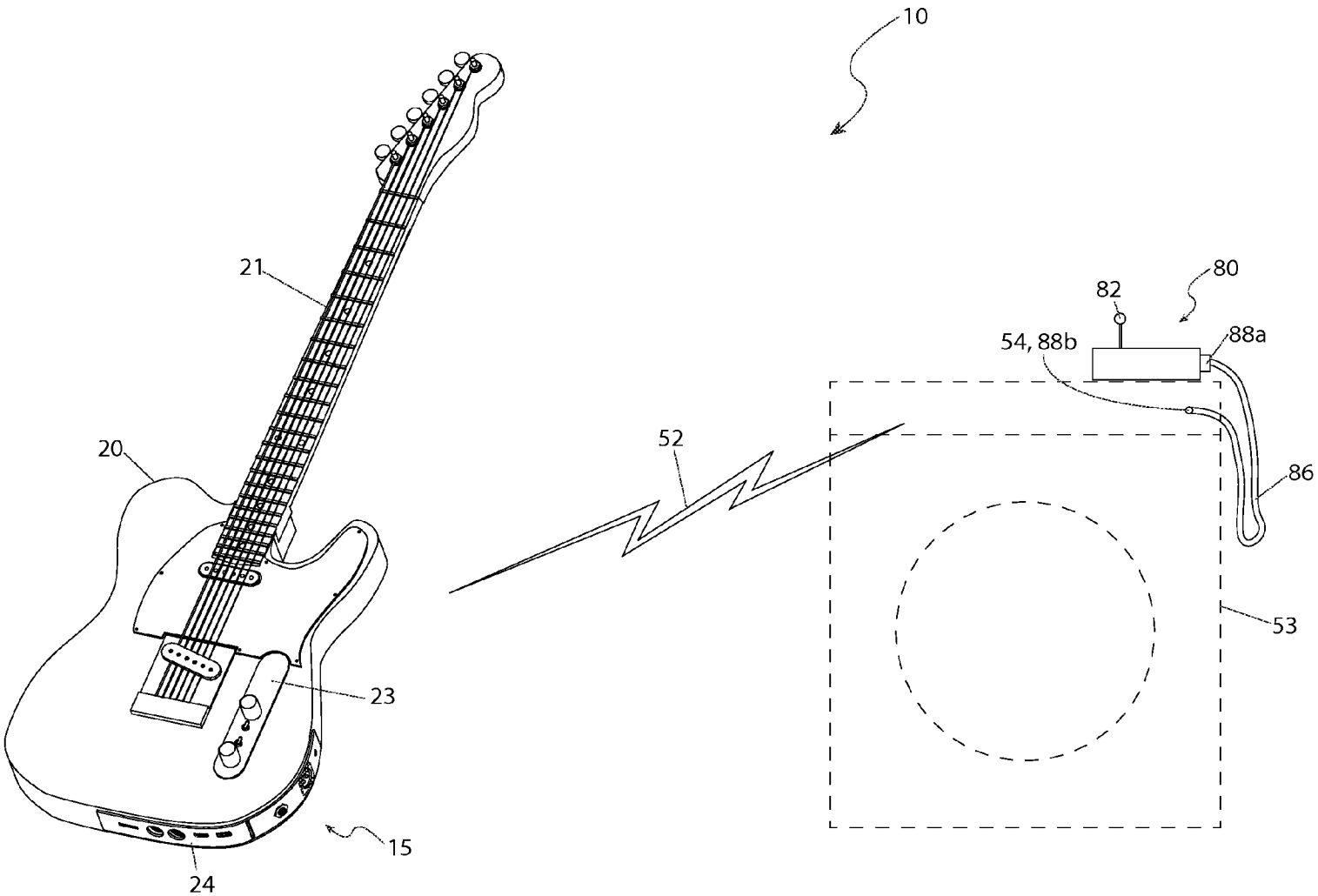
FIG. 1 is an environmental perspective view of a guitar system for personal electronic equipment 10, according to a preferred embodiment of the present invention.

10 guitar system
15 guitar assembly
20 body
21 neck
23 first control plate
24 second control plate
26*a* volume knob
26*b* tone knob
28 pre-amplifier
30*a* first switch
30*b* second switch
31 instrument cable port (TRS)
32 memory media slot
33 30-pin female connector
35 headphone port
38 first cavity
39 first cavity cover
40 second cavity
41 30-pin male connector
42 latch
43 MIDI input port
44 MIDI output port
46 USB port
47 HDMI port
48 XLR output port
50 circuit board
51 radio frequency (RF) transceiver
52 signal
53 amplifier/speaker
54 amplifier female connector
55 computer application device
60 charging stand
61 tripod legs
62 extension
63 head retainer
64 body retainer
65 power plug
66 input jack
70 first battery
72 battery charger
80 receiver module
82 antenna
84 second battery
86 amplifier cable
88*a* first amplifier cable connector
88*b* second amplifier cable connector

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIG. 1, an environmental perspective view of a guitar system for personal electronic equipment (herein described as the "system") 10, which comprises a guitar assembly 15 which provides analog and digital, hardwired and wireless operational modes. The guitar assembly 15 provides a means to removably attach and communicate with a computer application device 55 such as a tablet computer (see FIGS. 2, 3*a*, 3*b*). Integration of the guitar assembly 15 and the computer application device 55 enables communicating with, and managing of, various sound and music equipment to accomplish various related functions including broadcasting sound from an amplifier/speaker 53, sound recording, sound play-back, and the like. The system 10 can also be switched so as to operate in a normal analog guitar mode, in either wired or wireless configurations, if desired. Additionally, a user is able to access music, computer applications, or similar features through the computer application device 55 or via connection to storage media devices.

The system 10 also provides wireless operation via a radio frequency signal 52 between an RF transceiver 51 within the guitar assembly 15, and a receiver module 80 which works in conjunction with an existing amplifier/speaker 53 to broadcast sound and music wirelessly.

Figure 2:
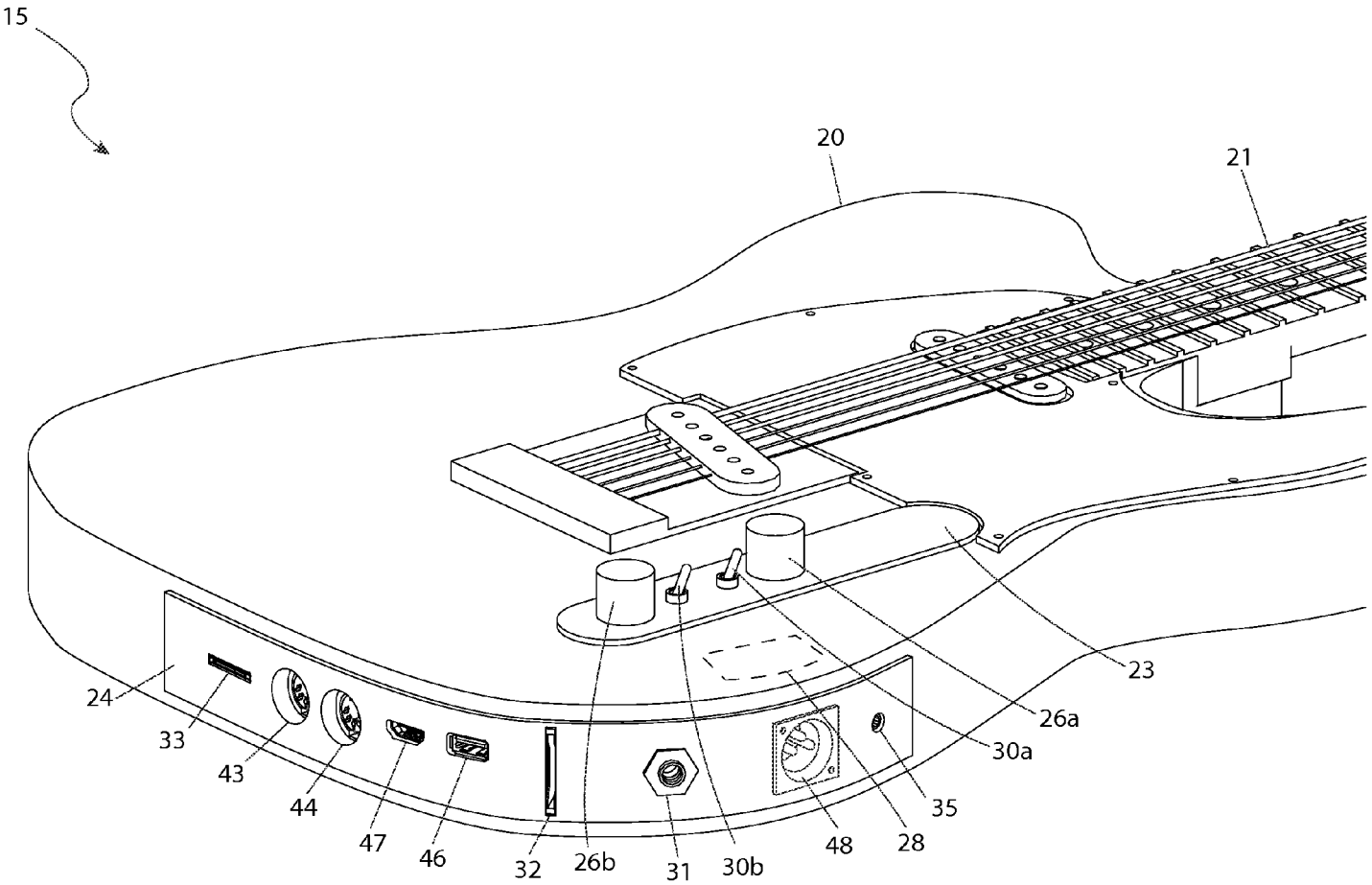
FIG. 2 is a top perspective view of a guitar assembly 15 of the guitar system for personal electronic equipment 10, according to a preferred embodiment of the present invention.
Figure 3A:
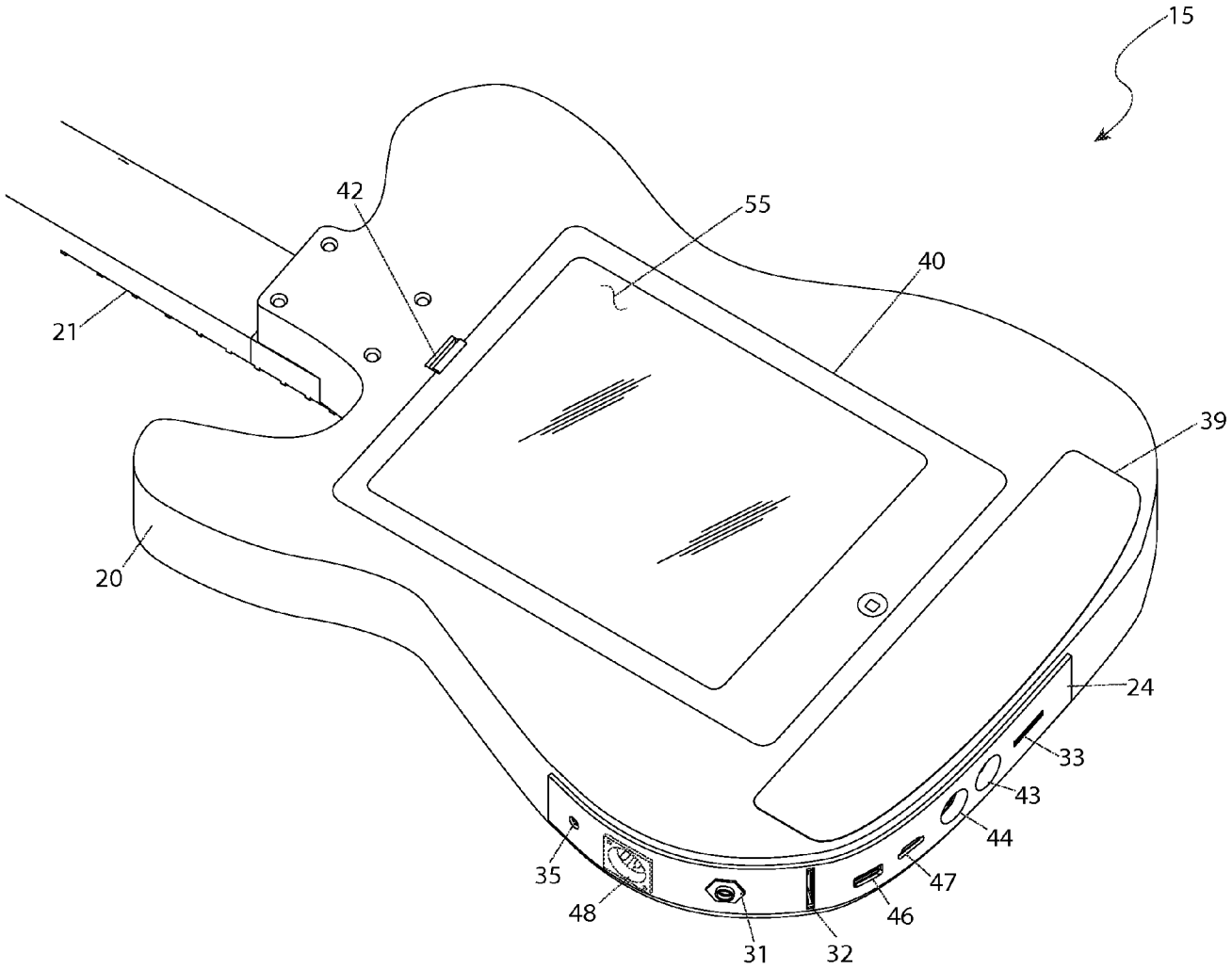
FIG. 3*a* is a bottom perspective view of the guitar assembly 15, according to a preferred embodiment of the present invention.
Figure 3B:
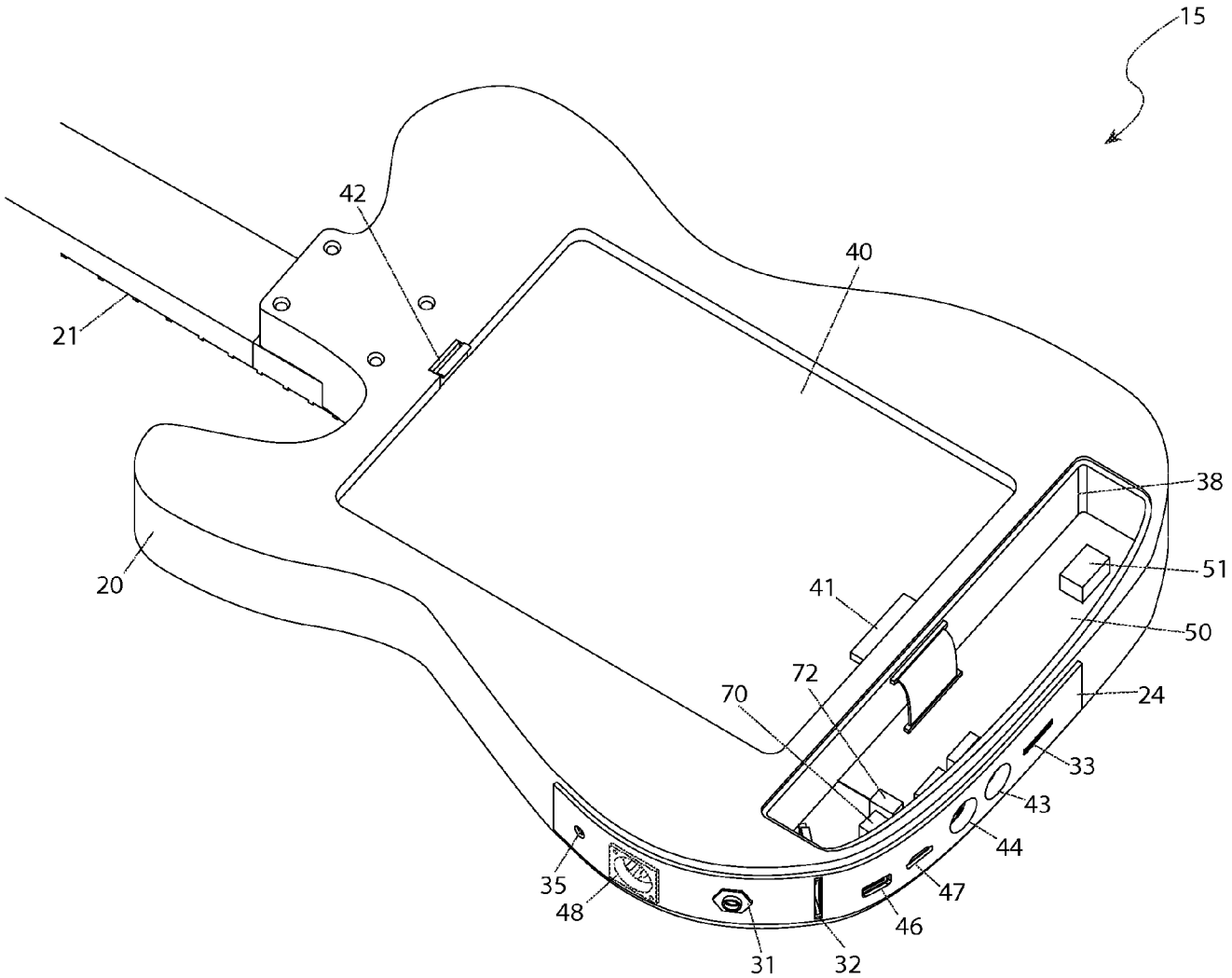
FIG. 3*b* is another bottom perspective view of the guitar assembly 15 depicting internal cavity portions 38, 40, according to a preferred embodiment of the present invention.

Referring now to FIGS. 2, 3*a*, and 3*b*, top and bottom perspective views of the guitar assembly 15, according to a preferred embodiment of the present invention, are disclosed. The system 10 comprises common features of a guitar assembly 15 such as, but not limited to: a body 20 and a neck 21. The system 10 is depicted here as a common electric guitar, yet other types may be utilized such as, but not limited to: an acoustic guitar, an acoustic-electric guitar, or the like. The body 20 is envisioned to comprise other common features of guitars such as a volume knob 26*a*, a tone knob 26*b*, and the like.

The body 20 includes a first control plate 23 along a front surface envisioned to comprise common guitar control features including a volume knob 26*a* and a tone knob 26*b*, as well as a first switch 30*a* and a second switch 30*b*. The first switch 30*a* enables the user to toggle the system 10 between a normal analog guitar mode and an enhanced digital mode of the system 10, thereby utilizing an internal circuit board 50, the computer application device 55, and various connected peripheral equipment. The second switch 30*b* enables a user to toggle the system 10 between wired and wireless modes. The switches 30*a*, 30*b* are preferably common toggle-type switching devices, yet other electrical switches may be utilized without limiting the scope of the system 10. The switches 30*a*, 30*b* are electrically interconnected to the internal circuit board 50.

A rear surface of the guitar body 20 comprises a first cavity 38, having a "snap-in" first cavity cover 39, which contains the circuit board 50, the RF transceiver 51, a rechargeable first battery 70, and a battery charger 72. The circuit board 50 comprises various electrical and electronic equipment including microprocessors, memory chips, embedded software, converters, a RF chip, Bluetooth technology, Wi-Fi technology, and the like, necessary to the function of the system 10. Said circuit board 50 is in electronic communication with the computer application device 55 via a 30-pin male connector 41. Additionally, the circuit board 50 is in communication with the RF transceiver 51, various peripheral equipment, and memory devices via corresponding connectors being mounted upon a second control plate 24 located along an end portion of the guitar body 20 including connectors such as, but not limited to: an amplifier/speaker jack (TRS) port 31, a memory media slot (SD) 32, a 30-pin female connector 33, a MIDI input port 43, a MIDI output port 44, a USB port 46, an HDMI port 47, and an XLR output port 48. Said connectors 31, 32, 33, 43, 44, 46, 47, 48 further enhance the playing of the system 10. Although these connectors 31, 32, 33, 43, 44, 46, 47, 48 are depicted upon an end surface of the body 20 it is understood that other surfaces or locations may be utilized without limiting the scope of the system 10. Each connector 31, 32, 33, 43, 44, 46, 47, 48 is electrically interconnected to the circuit board 50 using appropriate wiring and cables.

The XLR output port 48 may be utilized for a microphone or similar device; the memory media slot 32 may be used to insert devices such as SD cards and Micro SD cards; the USB port 46 may be utilized for communication purposes as well as for charging the first battery 70; the 30-pin female connector 33 may be utilized for electrical interconnection to various electrical devices; the HDMI port 47 may be used for audio/video interfacing; the headphone port 35 may be utilized for interconnection of an existing headphone device; and, the amplifier/speaker jack (TRS) port 31 may be utilized for interconnection to an existing guitar amplifier/speaker 53. It is understood that other controls can also be supplied on the body 20 without limiting the scope of the system 10.

The rear surface of the body 20 also comprises a second cavity 40 which enables a computer application device 55 such as a tablet computer to be mounted flush against the system 10. The computer application device 55 is secured into the second cavity 40 via a metal or plastic spring-loaded latch 42 incorporated into a perimeter edge of the second cavity 40 opposite the circuit board 50. The display portion of the computer application device 55 is envisioned to face outwardly toward the user to enable user access. The computer application device 55 is electrically interconnected to the circuit board 50 via engagement of an integral 30-pin connector portion of the computer application device 55 with a mating 30-pin male connector 41 mounted in a corresponding location along a perimeter edge of the second cavity 40. The 30-pin male connector 41 is located opposite the latch 42 and is envisioned to perform common charging/docking functions of the computer application device 55. It is understood that various connectors which are associated with various types of computer application devices 55 may be utilized in lieu of the 30-pin male connector 41 without limiting the scope of the system 10. The 30-pin male connector 41 is interconnected to the circuit board 50 to enable the features of the computer application device 55 to access and be accessed.

Figure 4A:
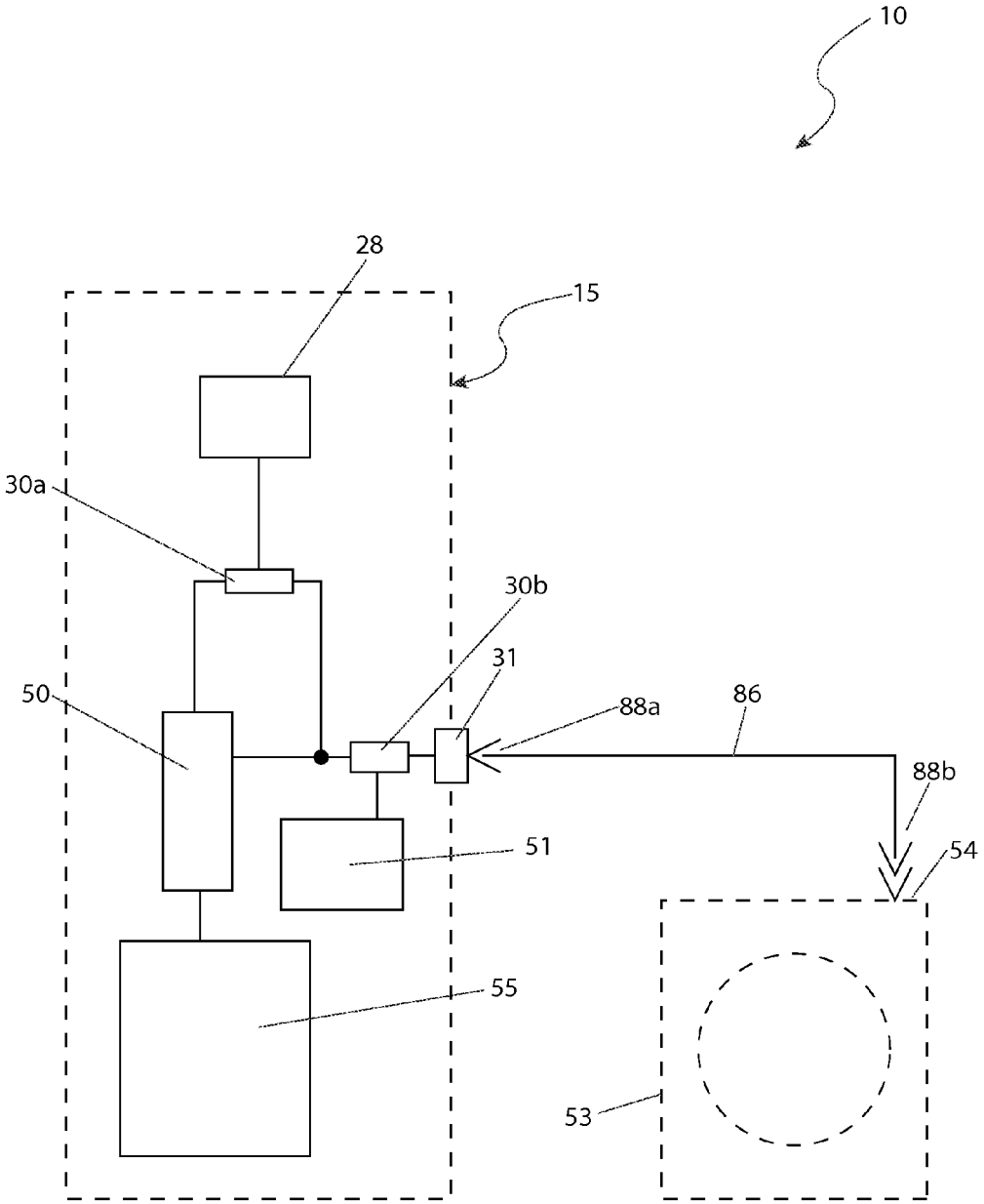
FIG. 4*a* is a functional block diagram depicting a hardwired configuration of the guitar system for personal electronic equipment 10, according to a preferred embodiment of the present invention.

Referring now to FIG. 4*a*, an electronic block diagram of the system 10, according to the preferred embodiment of the present invention, is disclosed. The system 10 comprises a first switch 30*a* which provides a means for a user to play the guitar assembly 15 in either a digital or an analog sound mode. For normal analog playing of the guitar assembly 15, the first switch 30*a* is positioned respectively to electrically bypass the circuit board 50 and computer application device 55 portions, thereby communicating sound from the preamplifier portion 28 of the guitar assembly 50 directly to the instrument cable port (TRS) 31. In this state a standard amplifier cable 86 is used to connect the guitar assembly 15 to an existing guitar amplifier/speaker 53, thereby broadcasting sound through a loudspeaker portion of said amplifier/speaker 53. The amplifier cable 86 further comprises a length of cable having first cable connector 88*a* and a second cable connector 88*b* portions at opposing ends. Said first 88*a* and second 88*b* cable connectors are plugged into the instrument cable port (TRS) 31 and an amplifier female connector 54 portion of the amplifier/speaker 53.

To enable the system 10 to operate in a digital mode and produce digital sound, the first switch 30*a* is positioned so as to activate the circuit board 50 and computer application device 55 portions. The digital sound produced may be recorded, played-back, and so on, as well as be broadcasted as previously described using the amplifier/speaker 53. When utilizing the computer application device 55, it is understood that the electronic and electrical power portions of said computer application device 55 may also be utilized. The computer application device 55 provides wireless technology to accesses apps, games, music, or the like in a normal fashion. These features are played in combination with the normal playing of the guitar assembly 15. The computer application device 55 is in electrical and electronic communication with the circuit board 50 via the 30-pin male connector 41. The circuit board 50 is envisioned to comprise appropriate converters, a microprocessor, a RF chip, Bluetooth technology, Wi-Fi technology, and the like.

Figure 4B:
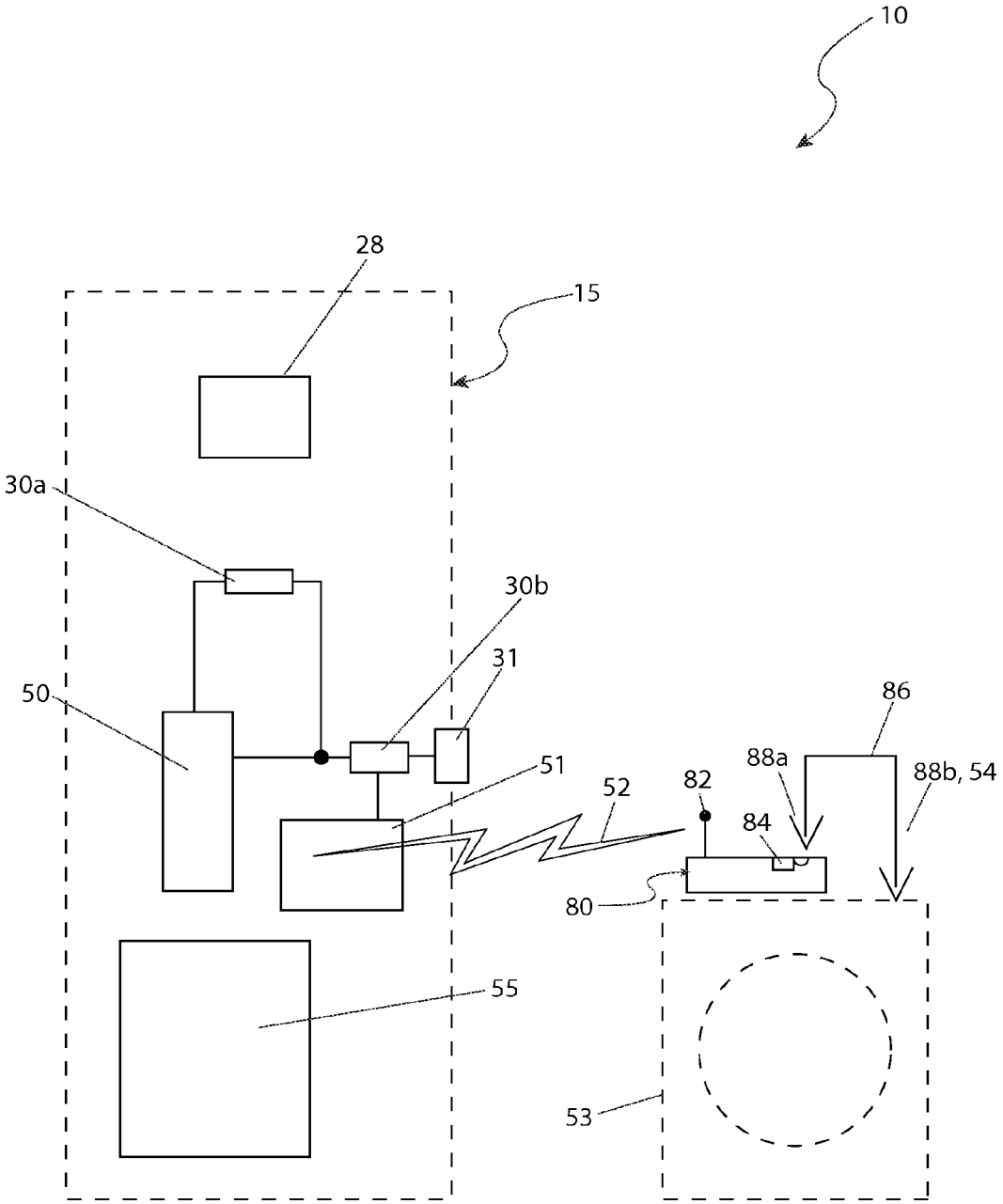
FIG. 4*b* is a functional block diagram depicting a wireless configuration of the guitar system for personal electronic equipment 10, according to a preferred embodiment of the present invention; and, FIG. 5 is a perspective view of a charging stand 60, according to a preferred embodiment of the present invention.

Referring now to FIG. 4*b*, a functional block diagram depicting a wireless configuration of the system 10, according to a preferred embodiment of the present invention, is disclosed. The system 10 comprises a second switch 30*b* which enables user selection of either wired or wireless transmission of both analog and digital sound data to the amplifier/speaker 53. The second switch 30*b* may be positioned so as to wirelessly communicate the sound data to the amplifier/speaker 53 via activation of a RF transceiver 51 within the guitar body 20. The RF transceiver 51 may be integrated into the circuit board 50 or act as a stand-alone device within the guitar body 20. The RF transceiver 51 works in conjunction with a receiver module 80 being directly wired to the amplifier/speaker 53 via an amplifier cable 86. The receiver module 80 is envisioned to be powered via an internal second battery 84. The amplifier cable 86 is envisioned to be plugged into the receiver module 80 and into the amplifier female connector 54 portion of the amplifier/speaker 53. A wireless signal 52 is transmitted from the RF transceiver 51 to an antenna portion 82 of the receiver module 80. The receiver module 80 in turn converts and conducts the sound data to the amplifier/speaker 53 via the amplifier cable 86.

Figure 5:
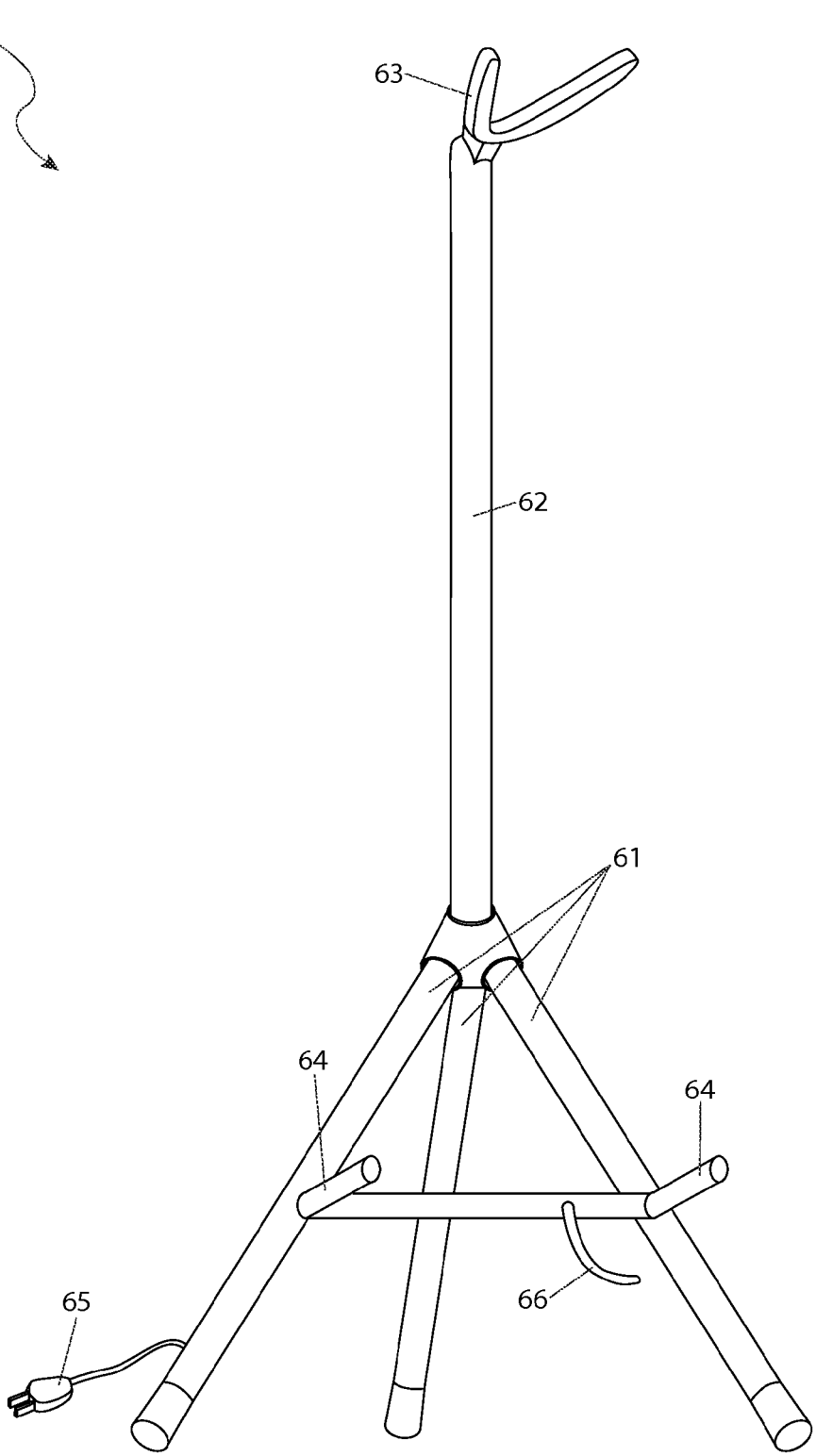

Referring now to FIG. 5, perspective view of the charging stand 60, according to the preferred embodiment of the present invention, is disclosed. An accessory of the system 10 is a portable charging stand 60 which enables the system 10 to be retained and also provides charging capabilities to the computer application device 55 and first battery 70 portions. The charging stand 60 comprises common tripod legs 61 which are common to guitar stands. The tripod legs 61 provide a platform to retain the weight of the system 10. The tripod legs 61 also comprise a body retainer 64 which support and suspend the system 10. An extension 62 is interconnected to the tripod legs 61 and transitions into a neck retainer 63. The neck retainer 63 engages the neck portion 21 of the system 10. Routed within the tripod legs 61 is a power plug 65 with integral input jack 66. The power plug 65 is connected to a household electrical outlet and routes power through the input jack 66 and into the USB port portion 46 of the system 10 to charge the first battery 70 and to charge/power the computer application device 55. It is known that other similar electrical configurations can be utilized for the charging stand 60 without limiting the scope of the system 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIGS. 1 and 3*a*.

The method of preparing the system 10 to perform wired analog and digital modes may be achieved by performing the following steps: acquiring the system 10; installing the computer application device 55 into the second cavity 40 by engaging the 30-pin male connector 41 and securing with the latch 42; placing the guitar assembly 15 upon the charging stand 60; plugging the power plug 65 into a household electrical outlet; plugging the input jack 66 into the USB port portion 46 of the system 10 for a period of time to charge the first battery 70 and the computer application device 55; removing the guitar assembly 15 from the charging stand 60; connecting the system 10 to an existing amplifier/speaker 53 using the amplifier cable 86; positioning the first switch 30*a* into a normal analog guitar mode; and, playing the system 10 in a common analog guitar manner. The system may be operated in the digital mode by positioning the first switch 30*a* into a digital guitar mode; utilizing the capabilities of the computer application device 55 to accesses apps, games, music, or the like, in combination with the normal playing of the guitar assembly 15; utilizing the XLR output port 48 for connection of a microphone or similar device; utilizing the memory media slot 32 to insert devices such as SD cards and Micro SD cards; utilizing the USB port 46 for communication purposes as well as for charging the first battery 70; utilizing the 30-pin female connector 33 for electrical interconnection to various electrical devices; utilizing the HDMI port 47 for audio/video interfacing; utilizing the headphone port 35 for interconnection of an existing headphone device; and, utilizing the amplifier/speaker jack (TRS) port 31 for interconnection to an existing guitar amplifier/speaker 53.

The method of utilizing the system 10 in wireless analog and digital modes may be achieved by performing the following steps: acquiring an accessory receiver module 80 of the system 10; installing a fresh second battery 84 within the receiver module 80; positioning the receiver module 80 upon, or adjacent to, the amplifier/speaker 53; connecting the receiver module 80 to the amplifier/speaker 53 using the amplifier cable 86; setting the second switch 30*b* to a wireless mode; and, operating the guitar assembly 15 in a wireless manner to broadcast either analog or digital sound from the amplifier/speaker 53 as previously described above.

The first battery 70 and computer application device 55 may be recharged after use by replacing the guitar assembly 15 upon the charging stand 60 and inserting the input jack 66 into the USB port portion 46 of the system 10 for a period of time to recharge the first battery 70 and the computer application device 55.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An electrical interface system for a musical instrument, comprising:

a guitar comprising a guitar body, a neck extending outward from said guitar body, a head at an end of said neck, and a plurality of strings each having a tuning peg;

a plurality of guitar controls, comprising at least one of the following: a volume knob and a tone knob, each located on a guitar control plate located on said guitar body;

a plurality of input and output ports located on said guitar body, comprising at least one of the following: an XLR port, a USB input, an SD card input, a Micro SD card input, a female connector configured for electrical interconnection to an external electrical components, an HDMI output, a headphone input, and an amplifier input, each one located on a digital control plate;

internal circuitry located within a compartment of said guitar body and in electrical communication with said plurality of input and output ports, comprising:

a circuit board;

a transceiver in electrical communication with said circuit board;

a power supply in electrical communication with said circuit board and said transceiver; and, a charger in electrical communication with said power supply;

a control means in electrical communication with said internal circuitry, comprising:

a first switch in electrical communication with said internal circuitry for selective switching between an analog mode and a digital mode; and, a second switch in electrical communication with said transceiver for selective switching between wired and wireless communication;

a cavity located on a rear of said guitar body adjacent to said compartment and configured to receive a portable electronic device therein and enable an outer perimeter of said personal electronic device to be flush with a surface of said guitar body; and, a spring-loaded latch incorporated into a perimeter edge of said cavity to retain said personal electronic device within said cavity;

wherein said internal circuitry is adapted to be in electrical communication with said portable electronic device when placed within said cavity wherein, when in said analog mode said first switch bypasses said circuit board and said personal electronic device, thereby communicating sound from a pre-amplifier of said guitar directly to an instrument cable port;

wherein, when in said digital mode said first switch activates said circuit board and said personal electronic device, thereby communicating a digital signal directly to an instrument cable port;

wherein, when in said wired communication, said system selectively communicates sound when in said analog mode or said digital signal when in said digital mode; and, wherein, when in said wireless communication, said system selectively communicates sound when in said analog mode or said digital signal when in said digital mode via said transceiver configured to wireless communicate with a speaker assembly.

2. The system of claim 1, wherein said cavity comprises a cavity cover.

3. The system of claim 1, wherein said digital control plate is located on an end portion of said guitar body.

4. An electrical interface system for a musical instrument, comprising:

a guitar comprising a guitar body, a neck extending outward from said guitar body, a head at an end of said neck, and a plurality of strings each having a tuning peg;

a guitar stand for retaining said guitar in a stored position;

a plurality of guitar controls, comprising at least one of the following a volume knob and a tone knob, each located on a guitar control plate located on said guitar body;

a plurality of input and output ports located on said guitar body, comprising at least one of the following: an XLR port, a USB input, an SD card input, a Micro SD card input, a female connector configured for electrical interconnection to an external electrical components, an HDMI output, a headphone input, and an amplifier input, each one located on a digital control plate;

internal circuitry located within a compartment of said guitar body and in electrical communication with said plurality of input and output ports, comprising:

a circuit board;

a transceiver in electrical communication with said circuit board;

a power supply in electrical communication with said circuit board and said transceiver; and, a charger in electrical communication with said power supply;

a control means in electrical communication with said internal circuitry, comprising:

a first switch in electrical communication with said internal circuitry for selective switching between an analog mode and a digital mode; and, a second switch in electrical communication with said transceiver for selective switching between wired and wireless communication;

a cavity located on a rear of said guitar body adjacent to said compartment and configured to receive a portable electronic device therein and enable an outer perimeter of said personal electronic device to be flush with a surface of said guitar body; and, a spring-loaded latch incorporated into a perimeter edge of said cavity to retain said personal electronic device within said cavity;

wherein said internal circuitry is adapted to be in electrical communication with said portable electronic device when placed within said cavity wherein, when in said analog mode said first switch bypasses said circuit board and said personal electronic device, thereby communicating sound from a pre-amplifier of said guitar directly to an instrument cable port;

wherein, when in said digital mode said first switch activates said circuit board and said personal electronic device, thereby communicating a digital signal directly to an instrument cable port;

wherein, when in said wired communication, said system selectively communicates sound when in said analog mode or said digital signal when in said digital mode; and, wherein, when in said wireless communication, said system selectively communicates sound when in said analog mode or said digital signal when in said digital mode via said transceiver configured to wireless communicate with a speaker assembly.

5. The system of claim 4, wherein said cavity comprises a cavity cover.

6. The system of claim 4, wherein said digital control plate is located on an end portion of said guitar body.

7. The system of claim 4, wherein said guitar stand further comprises;

a tripod portion;

a body retainer attached to said tripod portion;

an extension having a first end connected to said tripod portion;

a neck retainer attached adjacent to a second end of said extension; and, a charging cord routed within said tripod portion adapted to be in electrical communication with said internal circuitry of said guitar.

8. A method of utilizing a musical instrument connected to a personal electronic device comprises the following steps:

providing said guitar accessory, further comprising a guitar having a body, a neck, a head, tuning pegs, and strings; a plurality of guitar controls; a plurality of input and output ports; internal circuitry located within said guitar body, further including a circuit board, a power supply, and a transceiver; a first control switch and a second control switch each in electrical communication with said internal circuitry; and, a cavity having a latch, said cavity configured to receive a portable electronic device therein;

placing said personal electronic device within said cavity;

securing said personal electronic device within said cavity with said latch;

interconnecting said personal electronic device to said internal circuitry;

activating said electronic device;

utilizing said first switch to selectively switch said guitar accessory to an analog mode or a digital mode, wherein said analog mode bypasses said personal electronic device and said circuit board and outputs an analog signal to an output port and wherein said digital mode activates said personal electronic device and outputs a digital signal to said output port;

utilizing said second switch to selectively switch said guitar accessory to a wired connection or a wireless connection, wherein said wireless connection activates said transceiver;

utilizing said plurality of input and output ports; and, playing said guitar accessory.

* * * * *